United States Patent [19]

Ahmed

[11] 4,095,164

[45] June 13, 1978

[54] VOLTAGE SUPPLY REGULATED IN PROPORTION TO SUM OF POSITIVE- AND NEGATIVE-TEMPERATURE-COEFFICIENT OFFSET VOLTAGES

[75] Inventor: Adel Abdel Aziz Ahmed, Annandale, N.J.

[73] Assignee: RCA Corporation, New York, N.Y.

[21] Appl. No.: 729,796

[22] Filed: Oct. 5, 1976

[51] Int. Cl.[2] ..... G05F 1/56; G05F 1/60

[52] U.S. Cl. ..... 323/8; 323/1; 323/22 T; 330/257; 330/297

[58] Field of Search ..... 323/1, 4, 8, 19, 22 T, 323/38; 330/17, 18, 22, 23, 30 D, 40, 257, 297

[56] References Cited

U.S. PATENT DOCUMENTS

| | | | |
|---|---|---|---|
| 3,617,859 | 11/1971 | Dobkin et al. | 323/4 |
| 3,757,137 | 9/1973 | Ahmed | 330/30 D |
| 3,851,241 | 11/1974 | Wheatley | 323/8 |
| 3,887,863 | 6/1975 | Brokaw | 323/19 |
| 3,887,879 | 6/1975 | Radovsky | 330/30 D |
| 3,939,399 | 2/1976 | Funatsu et al. | 323/22 T |
| 3,940,708 | 2/1976 | Sumi et al. | 330/30 D |
| 3,946,325 | 3/1976 | Leidich | 330/40 X |
| 3,979,688 | 9/1976 | Maidique | 330/30 D |
| 4,021,722 | 5/1977 | Crowle | 323/4 |

OTHER PUBLICATIONS

Kuijk, "A Precision Reference Voltage Source," IEEE Journal of Solid State Circuits, vol. SC-8, No. 3, Jun. 1973, pp. 222-224.

Ahmed, "Zero-Offset Potential Follower Circuits," RCA Technical Notes, TN No. 938, Sep. 17, 1973, pp. 1-4.

*Primary Examiner*—A. D. Pellinen

*Attorney, Agent, or Firm*—H. Christoffersen; Allen LeRoy Limberg

[57] ABSTRACT

A regulated voltage supply comprising a degenerative feedback loop in which an amplified error signal provides either series-regulation or shunt-regulation of the output voltage. A negative-temperature-coefficient a forward-biased semiconductor junction is compared against a portion of the output voltage to develop the error signal. The comparison between these voltages is made in an unbalanced different-input amplifier configuration that provides a zero-valued error signal so long as there is a positive-temperature-coefficient potential difference between the voltages being compared. The output voltage is proportional to the sum of the negative- and positive-temperature-coefficient voltages and can be made temperature-independent by properly proportioning the summed voltages.

37 Claims, 12 Drawing Figures

VOLTAGE SUPPLY REGULATED IN PROPORTION TO SUM OF POSITIVE- AND NEGATIVE-TEMPERATURE-COEFFICIENT OFFSET VOLTAGES

The present invention relates to regulated voltage supplies of output voltages which are the sum of (a) a negative-temperature-coefficient voltage proportional to the offset potential across a forward-biased semiconductor junction and (b) a positive-temperature-coefficient voltage proportional to the difference between the offset potentials of two forward-biased semiconductor junctions operated with differing densities of current flow through them.

Such supplies are known generally from U.S. Pat. Nos. 3,617,859 (Dobkin etal) and 3,887,863 (Brokaw). These prior art supplies are not amenable to operation for supplying regulating potentials smaller than band-gap potential or to operation with supply voltages of less than 5 volts or so. The present invention permits substantially greater latitude in the design of regulated voltage supplies.

A differential-input amplifier configuration that provides zero-valued output signal as long as there is a positive-temperature-coefficient potential difference between the voltages being compared is described by Wheatley in U.S. Pat. No. 3,851,241.

A regulated voltage supply embodying the present invention includes a degenerative feedback loop in which an amplified error signal provides either series- or shunt-regulation of the output voltage. A negative-temperature-coefficient voltage that is proportional to the offset voltage across a forward-biased semiconductor junction is compared against a portion of the output voltage to develop the error signal. The comparison between these voltages is made in an unbalanced differential-input amplifier configuration that provides a zero-valued error signal so long as there is a positive-temperature-coefficient potential difference between the voltages being compared. The output voltage is proportional to the sum of the negative- and positive-temperature-coefficient voltages.

Figure 1:
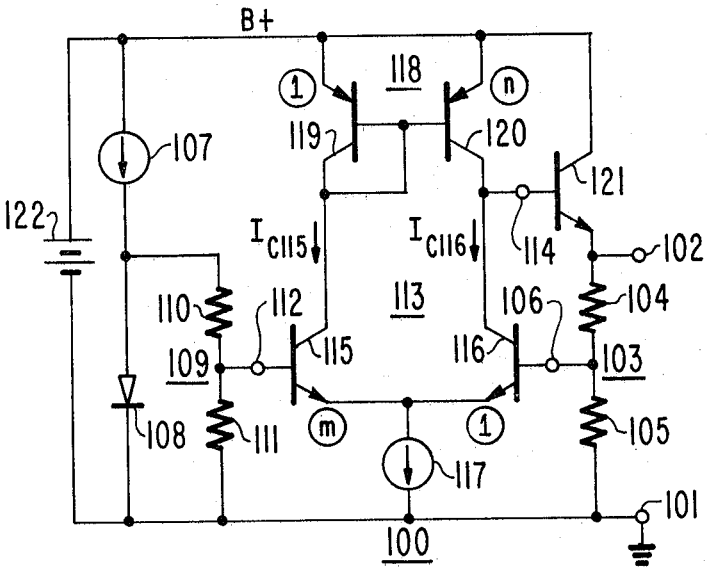
FIGS. 1 and 2 are schematic diagrams, each of a series voltage regulator embodying the present invention.

Referring to FIG. 1, the series voltage regulator 100 develops a regulated output voltage, $V_{OUT}$, between its terminals 101 and 102. A potential divider 103 comprising resistors 104 and 105 applies a voltage substantially equal to $V_{OUT}R_{105}/(R_{104}+R_{105})$ to terminal 106. The resistances $R_{104}$ and $R_{105}$ of resistors 104 and 105, respectively, are assumed to be small compared to the load imposed on the potential divider terminal 106.

Current source 107 supplies a substantially constant forward current, $I_{108}$, to semiconductor junction diode 108 (which may be a self-biased transistor). Assuming $I_{108}$ to be constant despite changes in temperature, the resulting offset voltage $V_{108}$ will (as is well-known) exhibit a negative-temperature-coefficient. A potential divider 109 comprising resistors 110 and 111 applies a voltage $V_{108}R_{111}/(R_{110}+R_{111})$ to terminal 112. The resistances $R_{110}$ and $R_{111}$ of resistors 110 and 111, respectively, are assumed to be small compared to the load imposed on terminal 112 and be large as compared to the resistance offered by diode 108.

Terminals 106 and 112 are the input terminals of a differential-input amplifier 113 which supplies an output current from terminal 114. This output current assumes a substantially zero value when the difference between the potentials at terminals 106 and 112 has a particular positive-temperature-coefficient value. The emitter-coupled transistors 115 and 116 have their respective base electrodes connected to terminals 112 and 106, respectively. Transistors 115 and 116 have base-emitter junctions with similar profiles and areas in m:l ratio as indicated by the encircled *m* and *l* near their respective emitters. Constant current source 117 determines the sum of the respective emitter currents $I_{E115}$ and $I_{E116}$ of transistors 115 and 116, responsive to which currents transistors 115 and 116 demand respective collector currents $I_{C115}$ and $I_{C116}$. $I_{C115}$ is amplified by a factor of $-n$ by the current mirror amplifier 118 comprising transistors 119 and 120. The base current $I_{B121}$ supplied to common-collector transistor 121 is, then, defined by the following equation.

$$I_{B121} = (-n)(-I_{C115}) - I_{C116} = nI_{C115} - I_{C116} \quad (1)$$

The values of $I_{C115}$ and $I_{C116}$ can be determined as a function of the differences, $\Delta V$, between the base potentials of transistors 115 and 116 by proceeding from the following equation descriptive of transistor action.

$$V_{BE} = (kT/q)ln(K_C/AJ_S) \quad (2)$$

wherein $V_{BE}$ is the base-emitter potential of the transistor,
$k$ is Boltzmann's constant,
T is the absolute temperature at which the transistor is operated,
$q$ is the charge on an electron,
$I_C$ is the collector current of the transistor,
A is the effective area of the base-emitter junction of the transistor, and
$J_S$ is the value of $I_C/A$ when $V_{BE} = 0$.

Transistors made concurrently by the same processing steps in a monolithic structure have substantially equal $J_S$'s and, if located proximate to each other in the structure, have substantially equal T's. The quantities $V_{BE}$, $I_C$ and A will bear the subscripts of the transistors to which they relate in equations 3 and 4, which particularize equation 2.

$$V_{BE116} = (kT/q)ln(I_{C116}/A_{116}J_S) \quad (3)$$

$$V_{BE115} = (kT/q)ln(I_{C115}/A_{115}J_S) \quad (4)$$

Equation 5 is derived by substituting equations 3 and 4 into the defining equation 5 for $\Delta V$.

$$\Delta V = V_{BE116} - V_{BE115} \quad (5)$$

$$\Delta V = (kT/q)ln(I_{C116}/I_{C115})(A_{115}/A_{116}) \quad (6)$$

For $I_{B121} = 0$, $I_{C116} = nI_{C115}$; and $A_{115}/A_{116} = m$. Substitution of these values into equation 6 defines the value of $\Delta V$ for which $I_{B121} = 0$.

$$\Delta V = (kT/q)lnmn \quad (7)$$

By choosing the product of $m$ times $n$ larger than unity, the $\Delta V$ for maintaining the error signal applied as base current to transistor 121 substantially zero will obtain when $V_{BE116}$ exceeds $V_{BE115}$.

The emitter of transistor 121 is connected to terminal 102 completing a degenerative feedback loop comprising potential divider 103, the differential-input amplifier 113 and transistor 121 connected as a common-collector amplifier. The error signal applied as base current $I_{B121}$ to transistor 121 is not exactly zero-valued but has the small positive value required to support an emitter current $I_{E121}$ from transistor 121 sufficient to develop the potential $V_{OUT}$ across the combined resistances of resistors 104 and 105. Supposing the common-emitter forward current gain of transistor 121 to be reasonably large (and, if necessary, transistor 121 can be replaced by a Darlington cascade connection of two or more transistors to make this so) $I_{B121}$ will be relatively small compared to $nI_{C115}$ and to $I_{C116}$. The degenerative feedback loop will tend to be in equilibrium, then, when the divided-down potential $V_{106} = R_{105} V_{OUT}/(R_{104}+R_{105})$ applied to terminal 106 equals the divided down potential $V_{112} = R_{111} V_{108}/(R_{110} + R_{111})$ at terminal 112 plus the $(kT/q)ln(mn)$ potential required between terminals 112 and 106 to maintain $nI_{C115}$ substantially equal to $I_{C116}$. The degenerative feedback loop will, then tend to maintain the following $V_{OUT}$ between terminals 101 and 102.

$$V_{OUT} = [(R_{104}+R_{105})/R_{105}] \cdot [R_{111}V_{108}/(R_{110}+R_{111})]+(kT/q)ln(mn) \quad (8)$$

Analyzing equation 8 one observes $V_{OUT}$ is the sum of the negative-temperature-coefficient potential $R_{111}(R_{104}+R_{105}) V_{108}/R_{105}(R_{110}+R_{111})$ and the positive-temperature-coefficient potential $[(R_{104}+R_{105})kT/q R_{105}]ln(mn)$. By choosing appropriate values of $R_{110}$, $R_{111}$, $m$ and $n$, $V_{OUT}$ can be made to be temperature-independent.

A $V_{OUT}$ appreciably larger than that of equation 8 will increase the $V_{105} = R_{105} V_{OUT}/(R_{104}+R_{105})$ potential applied to terminal 106. Its increased base potential vis-a-vis that of transistor 115 causes transistor 116 to demand a larger $I_{C116}$, while $I_{C115}$ is reduced. Since $I_{B121} = nI_{C115} - I_{C116}$, $I_{B121}$ is reduced. Responsive to the reduced $I_{B121}$, $I_{E121}$ is reduced. The reduced current flow through the resistors 104 and 105, reduces the potential drop due to $I_{E121}$ developed across them. $V_{OUT}$ is accordingly reduced towards the value set forth in equation 8. On the other hand, a $V_{OUT}$ appreciably smaller than that of equation 8 reduces the base potential of transistor 116, reducing $I_{C116}$ vis-a-vis $I_{C115}$. Since $I_{B121} = nI_{C115} - I_{C116}$, $I_{B121}$ and consequently $I_{E121}$ is increased. The increase of $I_{E121}$ increases the potential drop $V_{OUT}$ across the resistors 104 and 105.

In regulator 100, voltage supply 122, shown as a battery, supplies a positive operating potential B+ to the common connection of current mirror amplifier 118 and the collector electrode of transistor 121. Current source 107, for example, simply may comprise a resistive element, the current flow therethrough being by Ohm's Law equal to the potential drop thereacross, the B+ potential less the offset potential across diode 108, divided by its resistance. Current source 117 may be provided by a resistor connecting the interconnection of the emitter electrode of transistors 115 and 116 to a point of negative potential or by the collector-to-emitter path of a further transistor biased for constant current operation.

Figure 2:
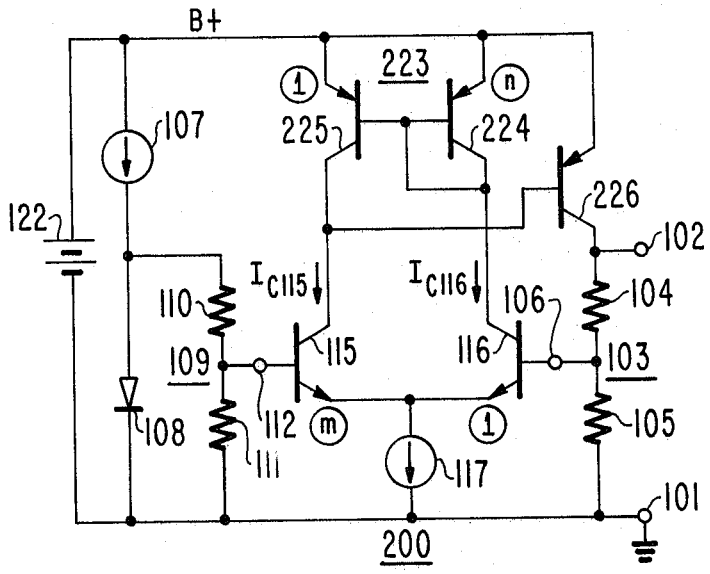

FIG. 2 shows a series voltage regulator 200 wherein means, alternative to current mirror amplifier 118, responds to the difference between fixed proportions of $I_{C115}$ and $I_{C116}$ to supply an error signal. The alternative means comprises a current mirror amplifier 223 including transistor 224 and 225. $I_{C116}$ is applied to the input connection of the current mirror amplifier 223, to cause a response current $I_{C116}/n$ to flow as collector current from transistor 225. Common-emitter amplifier transistor 226, the collector electrode of which is galvanically connected to output terminal 102, thus experiences as an error signal a base current $I_{B226}$ defined as follows in accordance with Kirchoff's Law of Currents.

$$I_{B226} = (I_{C116}/n) - I_{C115} \quad (9)$$

Figure 11:
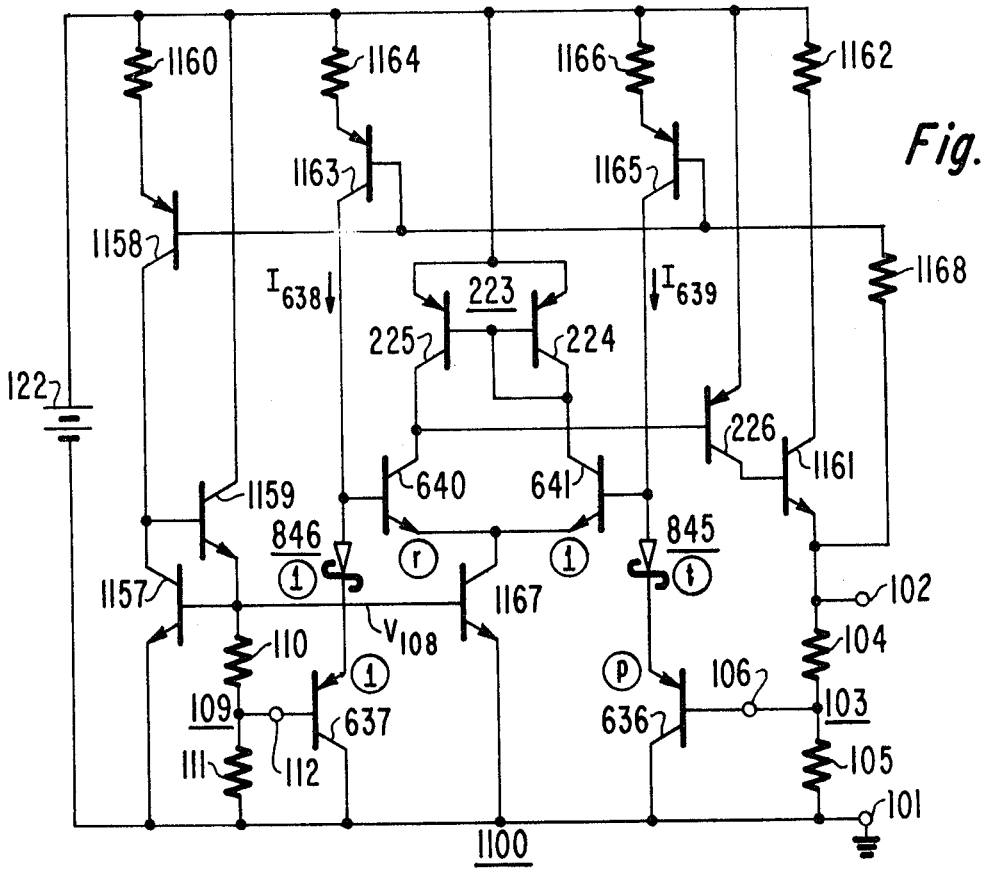
FIGS. 11 and 12 are schematic diagrams of, respectively, a series voltage regulator and a shunt voltage regulator, each embodying the present invention.

The inverting nature of its common-emitter amplifier configuration causes transistor 226 to supply a collector current proportional to $nI_{C115} - I_{C116}$, as before. In this connection, the scaling factor n reduces feedback loop gain rather than increasing it as with the FIG. 1 configuration. However, the FIG. 2 configuration has the attractive feature that the action of its feedback loop to maintain the collector potentials of current mirror amplifier transistors 224 and 225 substantially equal, forestalling departures of the current gain of amplifier 223 from $1/n$ due to "Early effect". Feedback loop gain in regulators per FIG. 2 can be increased by replacing transistor 226 with a compound device comprising an initial common-emitter amplifier transistor followed in cascade by at least one common-collector amplifier transistor of complementary conductivity type, as illustrated in FIG. 11.

Figure 3:
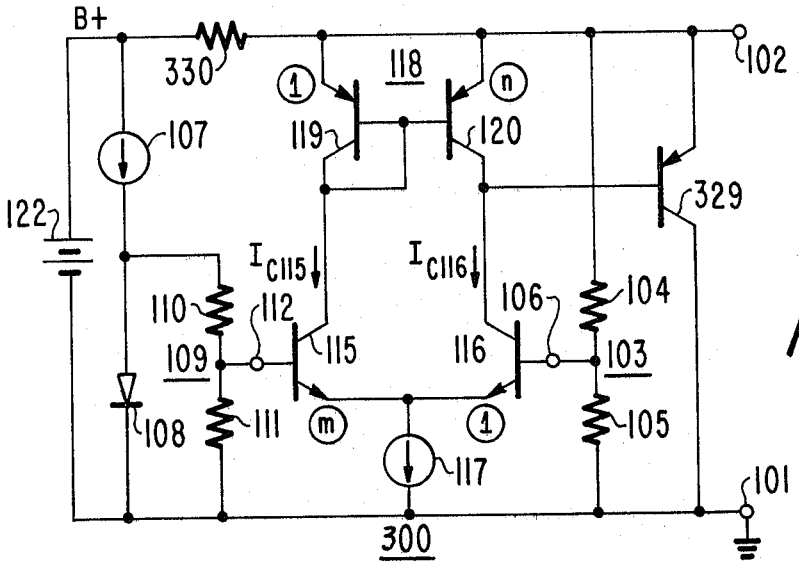
FIGS. 3 and 4 are schematic diagrams, each of a shunt voltage regulator embodying the present invention.

FIG. 3 shows a shunt voltage regulator 300 wherein an $n(_{C115} - I_{C116}$ error signal is applied to the base electrode of transistor 329. Responsive to the error signal transistor 329 exhibits decreased conduction if the voltage $V_{OUT}$ appearing between terminals 101 and 102 decreases below the value in equation 8. Decreased conduction of transistor 329 lessens the flow of current through dropping resistor 330, increasing $V_{OUT}$. The error signal will increase the conduction of transistor 329 if $V_{OUT}$ increases above the value in equation 8, and the resulting increased flow of current through dropping resistor 330 will increase the voltage drop thereacross, reducing $V_{OUT}$. Dropping resistor 330 might alternatively be connected between the common connection of current mirror amplifier 118 and terminal 102, rather than the B+, positive connection of supply 122. The connection shown avoids the influence of Early effect on the current gain of current mirror amplifier 118 by arranging transistors 119 and 120 to have substantially like-valued collector potentials.

Figure 4:
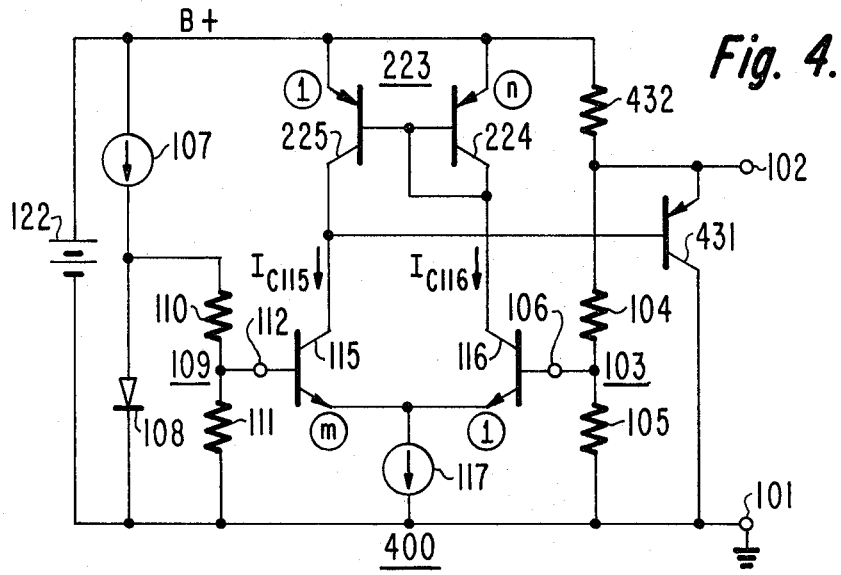

FIG. 4 shows a shunt voltage regulator 400 wherein a $(I_{C116}/n) - I_{C115}$ error signal is applied to the base electrode of transistor 431. Responsive to this error signal, transistor 431 exhibits decreased or increased conduction depending on whether the voltage $V_{OUT}$ between terminals 101 and 102 decreased below or increases above the value in equation 8. Decreased conduction of transistor 431 when $V_{OUT}$ decreases below the equation 8 value, decreases the current flow through dropping resistor 432; the resulting decreased potential drop across resistor 432 tends to increase $V_{OUT}$ to the equation 8 value. Increased conduction of transistor 431 when $V_{OUT}$ increases above the equation 8 value increases the current flow through dropping resistor 432; the resulting decreased potential drop across resistor 432 tends to decrease $V_{OUT}$ to the equation 8 value.

Figure 5:
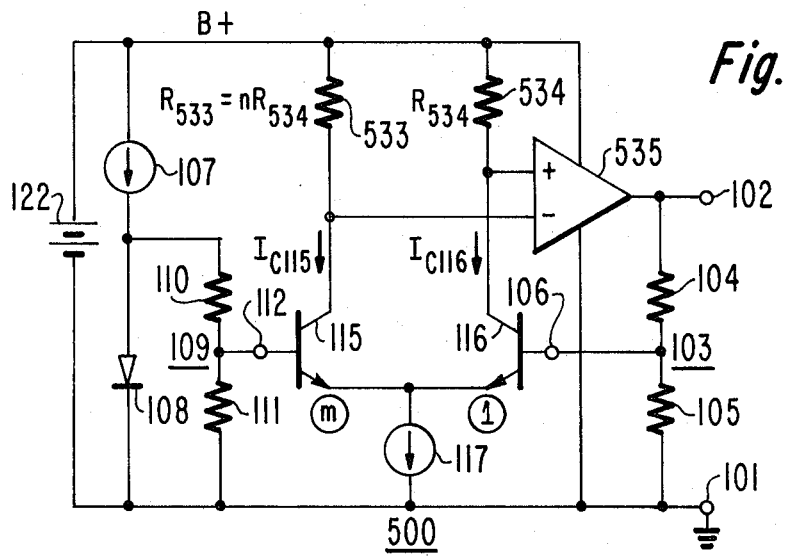
FIG. 5 is a schematic diagram partially in block form of another voltage regulator embodying the present invention.
Figure 6:
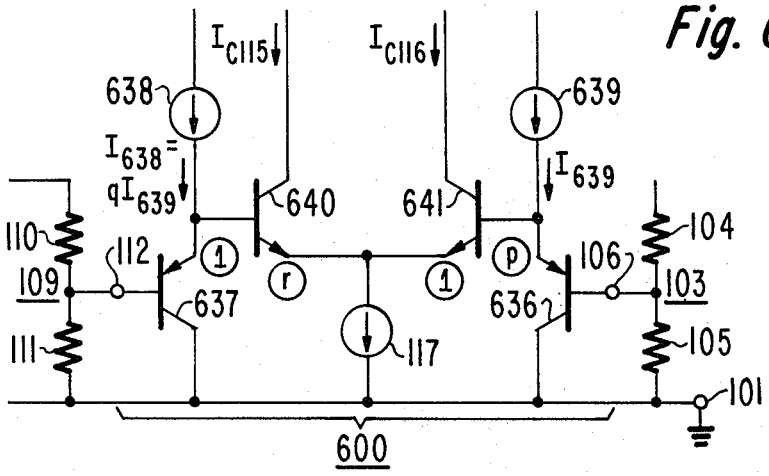
FIGS. 6, 7, 8, 9 and 10 are schematic diagrams, each showing a pair of transistor means suited for asymmetrical differential-input amplifier operation in accordance with the present invention.

FIG. 5 shows a voltage regulator 500 using still another means for responding to the difference between fixed proportions of $I_{C115}$ and $I_{C116}$ to supply an error signal. In accordance with ohm's Law, $I_{C115}$ causes a potential drop $nRI_{C115}$ across resistor 533, which has a resistance $R_{533}$ $n$ times as large as the resistance $R_{534}$ of resistor 534. In accordance with Ohm's Law, $I_{C116}$ causes a potential drop $R_{534}I_{C116}$ across resistor 534. The $nR_{534}$ $I_{C115}$ and $R_{534}$ $I_{C116}$ potential drops are applied to the inverting and non-inverting terminals, respectively, of a differential-input amplifier 535 (e.g., an operational amplifier) which supplies an output current to terminal 102 which is an amplified response proportional to $I_{C116} - nI_{C115}$.

Voltage regulator configurations similar to 100, 200, 300 or 400 of FIGS. 1–4, respectively, but in which current mirror amplifiers 118 and 223 are replaced by known equivalent current mirror configurations and in which any necessary modifications of the biasing of the emitter electrodes of transistors 226 and 329 needed to accomodate these changes are also feasible.

FIGS. 6, 7, 8, 9 and 10 show configurations 600, 700, 800, 900 and 1000 that each comprise a pair of transistor means that can replace the emitter-coupled pair of transistor 115 and 116 for generating the $I_{C115}$ and $I_{C116}$ currents that are differentially combined in predetermined proportion $n$ to develop the error signal in voltage regulators embodying the present invention. Transistors 636 and 637 have their collector electrodes biased to condition each of them for common-collector amplifier operation. Configuration 600 causes a value $m$ in equation 7 equal to the product of $p$ times $q$ times $r$ where: $p$ is the ratio of the effective area of the base-emitter junction of transistor 636 to that of transistor 637; $q$ is the ratio of the current $I_{638}$ supplied by source 638 to the emitter electrode of transistor 637, divided by the current $I_{639}$ supplied by source 639 to the emitter electrode of transistor 636; and $r$ is the ratio of the base-emitter junction of transistor 640 to that of transistor 641. Elements 637, 638 and 640 comprises transistor means for generating $I_{C115}$ and elements 636, 639 and 641 comprise transistor means for generating $I_{C116}$.

Figure 7:
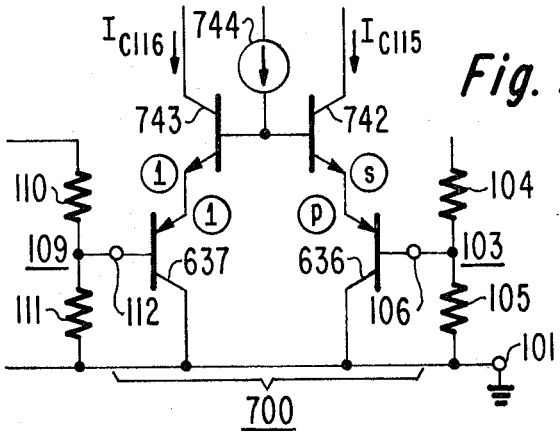

Configuration 700 of FIG. 7 causes a value of $m$ in equation 7 equal to the product of $p$ times $s$ where: $p$ is the ratio of the effective area of the base-emitter junction of transistor 636 to that of transistor 637, and $s$ is the ratio of the effective area of the base-emitter junction of transistor 742 to that of transistor 743. To this end, source 744 supplies the combined base current demands of transistors 742 and 743 from a relatively high source impedance compared to that presented by transistors 742 and 743 at the interconnection of their base electrodes. Elements 636 and 742 comprise transistor means for generating $I_{C115}$, and elements 637 and 743 comprise transistor means for generating $I_{C116}$. Configurations 600 and 700 provide the bases for unbalanced differential-input amplifiers that achieve larger values of $m$, permitting smaller division ratios for potential divider 109 and thus enhanced accuracy in the determination of larger zero-temperature-coefficient $V_{OUT}$ potentials, without taking up excessive area in a monolithic integrated circuit.

Figure 8:
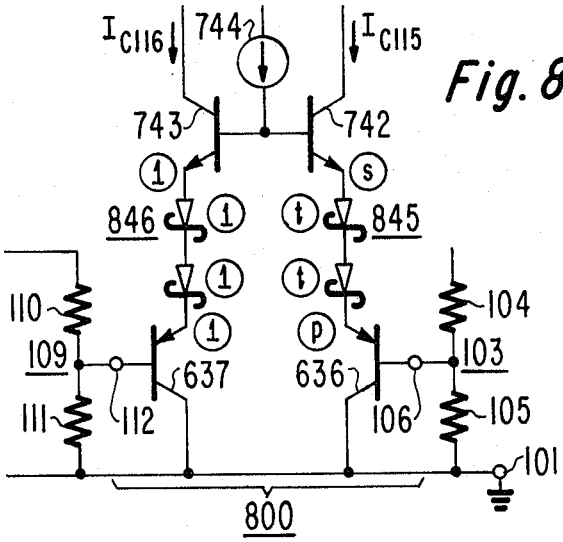
Figure 9:
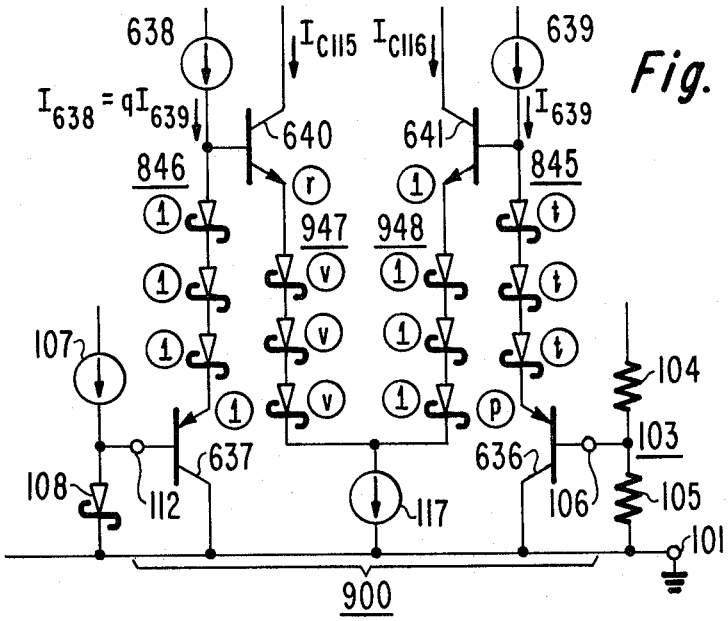

More savings of area on the monolithic circuit can be obtained through the use of further diodes as in configurations 800 and 900 of FIGS. 8 and 9, if the $m$ to be realized be sufficiently large. These additional diodes can be simple PN junctions, or self-biased transistors, but Schottky barrier diodes (e.g., of platinum-silicide-silicon types) can reduce the absolute values of the offset voltages necessary to obtain desired differences in relative offset voltages. Configuration 800, like configuration 700, is advantageous in that the same currents that flow through transistors 742 and 743 flow through transistors 636 and 637, respectively, to conserve current drain on the energizing supply. Configuration 800 causes a value of m in equaton 7 equal to $p$ times $s$ times $t^u$ where: $u$ is the number of diodes in each of serial connections 845 and 846 of diodes, and $t$ is the effective area of the diode junctions in serial connection 845 relative to that of the diode junctions in serial connection 846. Elements 636, 845 and 742 comprise transistor means for generating $I_{C115}$; and elements 637, 846 and 743 comprise transistor means for generating $I_{C116}$.

Configuration 900 of FIG. 9 causes a value of $m$ in equation 7 equal to $p$ times $q$ $(u+1)$ times $t^u$ times $v^w$ times $r$ where: $w$ is the number of diodes in each of the serial connections 947 and 948, and $v$ is the effective area of the diode junctions in serial connection 947 relative to that of the diode junctions in serial connection 948. It is relatively easy to generate large enough values of $m$ in configuration 900 to permit one to apply the full offset potential developed across diode 108 to terminal 112; as shown, if desired, in effect making $R_{111}/(R_{110}+R_{111})$ unity valued in equation 8. In configuration 900, elements 637, 846, 638, 640 and 947 comprise transistor means for generating $I_{C115}$; and elements 636, 845, 639, 641 and 948 comprise transistor means for generating $I_{C116}$. Placing elements 637 and 846 in one current path and elements 640 and 947 in another reduces the proportion of the B+ operating potential needed for getting a given number of junctions into the process of determining the offset potential of this transistor means versus the other.

Figure 10:
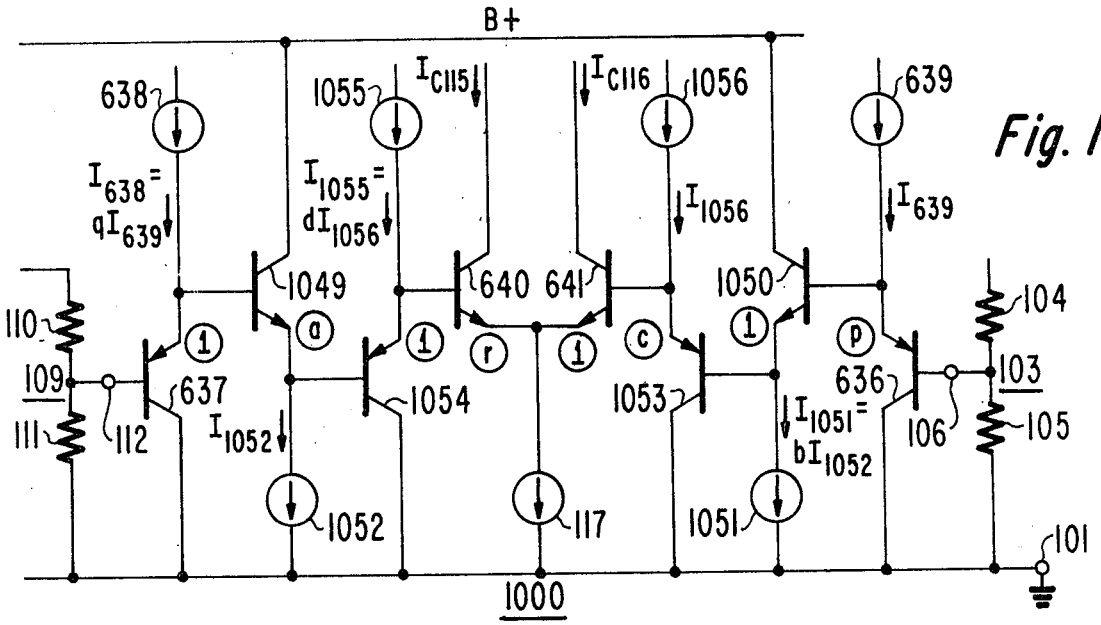

Use of still further current paths in each transistor means as shown in FIG. 10 can reduce the proportion of the B+ operating potential needed. There will be an associated tendency towards self-oscillation in the voltage regulator which, as appreciated by workers of average skill in the art, can be controlled by by-passing the feedback loop with a suitably placed capacitance.

Configuration 1000 of FIG. 10 causes a value of $m$ in equation 7 equal to the product $pqrabcd$ where: $a$ is the ratio of the effective area of the base-emiter junction of transistor 1049 to that of transistor 1050; $b$ is the ratio of the current $I_{1051}$ withdrawn by source 1051 from the emitter electrode of transistor 1050, divided by the current $I_{1052}$ withdrawn by source 1052 from the emitter electrode of transistor 1049; $c$ is the ratio of the effective area of the base-emitter junction of transistor 1053 to that of transistor 1054; and $d$ is the ratio of the current $I_{1055}$ supplied by source 1055 to the emitter electrode of transistor 1054, divided by the current $I_{1056}$ supplied by source 1056 to the emitter electrode of transistor 1053. Only about a volt of operating potential need be apportioned to this configuration. Elements 637, 638, 1049, 1052, 1054, 1055 and 640 comprise transistor means for generating $I_{C115}$; and elements 636, 639, 1050, 1051, 1053, 1056 and 641 comprise transistor means for generating $I_{C116}$.

FIG. 11 shows a series voltage regulator 1100 illustrating how one can handle various incidental problems concerning the design of voltage regulators embodying the present invention. The negative-temperature-coefficient potential $V_{108}$ is developed at the base electrode of grounded-emitter amplifier 1157 to adjust its collector current $I_{C1157}$ substantially to equal in amplitude a temperature-independent current $I_{C1158}$ supplied from the collector electrode of transistor 1158. The error signal current by which $I_{C1158}$ exceeds $I_{C1157}$ in amplitude is applied to the base electrode of emitter-follower transistor 1159, used to provide the direct-coupled collector-to-base feedback connection for transistor 1157. In this arrangement, emitter-follower transistor 1159 acts as a buffer amplifier, greatly reducing the tendency towards $I_{C1158}$ being diverted in part to the resistive potential divider 109, as would happen if the collector-to-base feedback connection of transistor 1157 were provided by direct connection rather than by emitter-follower transistor 1159.

$I_{C1158}$ is temperature-independent if a proper value temperature-independent voltage is applied across the series connection of its base-emitter junction and its positive-temperature-coefficient emitter degeneration resistor 1160. This voltage is obtained by scaling from the temperature-independent potential $V_{OUT}$ in a resistance amplifier essentially consisting of transistor 1161, with emitter-resistance provided by the series connection of resistors 104 and 105 of potential divider 103, and with collector resistance provided by resistor 1162 across which appears the temperature-independent potential sought for application to elements 1158 and 1160. This potential is also applied across the series connection of the base-emitter junction of transistor 1163 and its emitter degeneration resistor 1164, to generate the $I_{638}$ current flow from its collector electrode, and across the series connection of the base-emitter junction of transistor 1165 and its emitter degeneration resistor 1166, to generate the $I_{639}$ current flow from its collector electrode.

Transistor 1161 is in cascade connection with transistor 226 to improve the loop gain of the basic voltage regulating function determining $V_{OUT}$. $V_{108}$ is applied to the base electrode of grounded-emitter transistor 1167 to bias it for placing constant collector current demand on the joined emitter electrodes of transistors 640 and 641. Resistor 1168 shunting the collector-to-emitter path of transistor 1161 is used to prevent an undesired equilibrium condition in the regulator 1100 wherein none of the transistors is conductive, necessary where, as here, current levels in the circuit are determined regeneratively.

Figure 12:
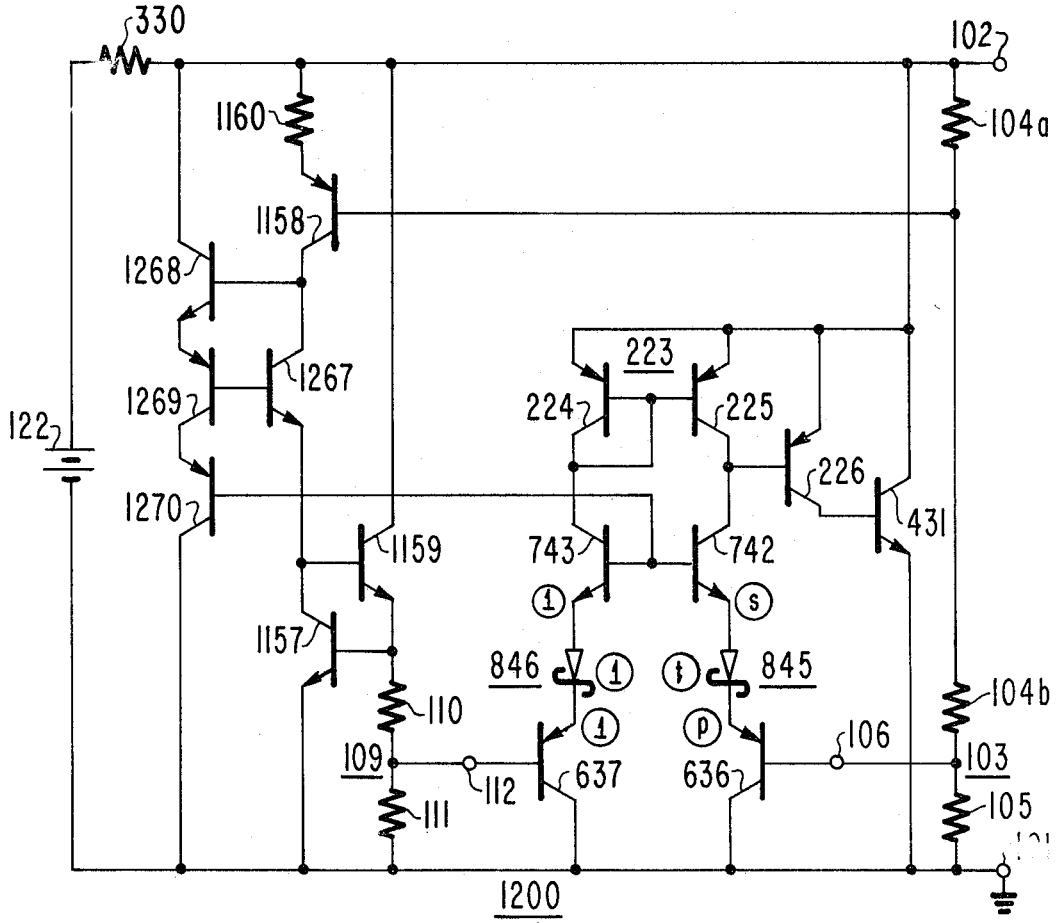

FIG. 12 shows a shunt voltage regulator 1200, which type of regulator is attractive for monolithic integrated circuits where the dropping resistor 330 as well as supply 122 are located off-circuit. Attractive, because the power dissipation in the resistor 330 does not heat up the integrated circuit. In regulator 1200 resistor 104 is in two parts **104*a* and 104*b*, the potential drop across resistor 104a being used to bias transistor 1158 for supplying a constant collector current, $I_{C1158}$. $I_{C1158}$ is supplied to the collector of transistor 1157 primarily via the collector-to-emitter 104*a* path of transistor 1267. Transistor 1267 is conditioned to pass this current by direct-coupled collector-to-base feedback, the connection being made via emitter-follower transistor 1268 and the forward-biased emitter-base junction of transistor 1269. The base current $I_{B1269}$ of transistor 1269 is equal in amplitude to the base current $I_{B1267}$ of transistor 1267 required for regulating the collector current $I_{C1267}$ of transistor 1267 so as to substantially equal $I_{C1158}$ in amplitude. The collector current $I_{C1269}$ of transistor 1269 is applied to the emitter electrode of similar type transistor 1270 to cause a base current $I_{B1270}$ to flow from transistor 1270, which $I_{B1270}$ is substantially equal to $I_{B1269}$ and thus to $I_{B1267}$. The current is divided between the base electrodes of transistors 742 and 743** to proportion their collector currents to $I_{C1158}$.

A wide variety of voltage regulators may be constructed based on the principles of the present invention, as should be apparent from the numerous examples set forth above, and the scope of the following claims should be accordingly construed.

What is claimed is:

1. A regulated potential supply comprising:

first and second terminals;

current conductive means between said first and said second terminals;

first and second transistor means of the same conductivity type, each having an output current conducting path and a control terminal, the output current of each of said first and said second transistor means being controlled responsive to the potential appearing between its control terminal and said first terminal;

means responsive to potential appearing between said first and second terminals to continuously supply a fraction thereof between said first terminal and the control terminal of said first transistor means, which fraction is between zero and unity;

means for generating a negative-temperature-coefficient potential;

means responsive to said negative-temprature-coefficient potential to continuously supply a fraction thereof between said first terminal and the control terminal of said second transitor means, which fraction is between zero and unity;

means responsive to the difference between fixed proportions of the output currents of said first and said second transistor means for supplying an error signal, said fixed proportions chosen to cause said error signal to be substantially zero-valued when a positive-temperature-coefficient potential appears between the respective control terminals of said second and said first transistor means that summed with said fraction of negative temperature coefficient potential results in a substantially zero-temperature-coefficient potential; and means responsive to said error signal to supply a current directly related in amplitude to said error signal to said second terminal, thereby completing a degenerative feedback loop for regulating the potential between said first and said second terminals to a substantially-temperature-independent voltage proportional to said substantially zero-temperature-coefficient potential.

2. A regulated potential supply as set forth in claim 1 wherein said means for generating a negative-temperature-coefficient potential comprises a semiconductor diode and means for applying a forward biasing current to said semiconductor diode, responsive to which said negative-temperature-coefficient potential is developed across said semiconductor diode; and wherein said means responsive to said negative-temperature-coefficient potential to continuously supply a fraction thereof between said first terminal and the control terminal of said second transistor means is a potential divider comprising a first resistance and a second resistance in series connection across said semiconductor diode, said second resistance also being connected between the control terminal of said second transistor means and said first terminal.

3. A regulated potential supply as set forth in claim 1 wherein said means for generating a negative-temperature-coefficient potential comprises a first transistor of a first conductivity type having base and emitter electrodes with a base-emitter junction therebetween, having a collector electrode, and being provided with direct coupling of its collector electrode to its base electrode, the emitter electrode of said first transistor being connected to said first terminal; means applying a current to the collector electrode of said first transistor, which the direct coupling of its collector electrode to its base electrode conditions said first transistor by feedback to accept as its collector current and thereby develops said negative-temperature-coefficient offset potential between the emitter and base electrodes of the first transistor; and wherein said means responsive to said negative-temperature-coefficient potential to continuously supply a fraction thereof between said first terminal and the control terminal of said second transistor means is a potential divider comprising a first resistance between the base electrode of said first transistor and the control terminal of said second transistor means and a second resistance between the control terminal of said second transistor means and said first terminal.

4. A regulated potential supply as set forth in claim 1 wherein said first transistor means includes a first transistor of a first conductivity type having base and emitter electrodes with a base-emitter junction therebetween and having a collector electrode for supplying the output current of said first transistor means, and further including means for direct coupling the control terminal of said first transistor means to the base electrode of said first transistor; wherein said second transistor means includes a second transistor of said first conductivity type having base and emitter electrodes with a base-emitter junction therebetween and having a collector electrode for supplying the output current of said second transistor means, and further including means for direct coupling the control terminal of said second transistor means to the base electrode of said second transistor; and wherein is included means for applying a current to an interconnection of the emitter electrodes of said first and said second transistors of a poling to forward bias their responsive base-emitter junctions.

5. A regulated potential supply as set forth in claim 4 wherein said means for direct coupling the control terminal of said first transistor means to the base electrode of said first transistor consists of a direct connection without substantial impedance and wherein said means for direct coupling the control terminal of said second transistor means to the base electrode of said second transistor also consists of a direct connection without substantial impedance.

6. A regulated potential supply as set forth in claim 4 wherein said means for direct coupling the control terminal of said first transistor means to the base electrode of said first transistor includes a third transistor of a second conductivity type in common-collector amplifier configuration; and wherein said means for direct coupling the control terminal of said second transistor means to the base electrode of said second transistor includes a fourth transistor of said second conductivity type in common-collector amplifier configuration, said second conductivity type being complementary to said first conductivity type.

7. A regulated potential supply as set forth in claim 4 wherein said means for supplying an error signal comprises a current mirror amplifier having input and output connections to which the collector electrodes of said first and said second transistors are respectively connected; and wherein said means responsive to said error signal comprises a fifth transistor of said first conductivity type having a base electrode to which the output connection of said current mirror amplifier is direct coupled, having a collector electrode biased to condition said fifth transistor for common-collector amplifier operation, and having an emitter electrode connected to said second terminal.

8. A regulated potential supply as set forth in claim 4 wherein said means for supplying an error signal comprises a current mirror amplifier having input and output connections to which the collector electrodes of said second and said first transistors are respectively connected; and wherein said means responsive to said error signal comprises a fifth transistor being of a second conductivity type complementary to the first conductivity type, having a base electrode to which the output connection of said current mirror amplifier is direct coupled, having an emitter electrode biased to condition said fifth transistor for common-emitter amplifier operation, and having a collector electrode connected to said second terminal.

9. A regulated potential supply as set forth in claim 4 wherein said means for supplying an error signal comprises a current mirror amplifier having input and output connections to which the collector electrodes of said first and said second transistors are respectively connected; and wherein said means responsive to said error signal comprises a fifth transistor being of a second conductivity type complementary to said first conductivity type, having a base electrode to which the output connection of said current mirror amplifier is direct coupled, and having collector and emitter electrodes connected respectively to said first terminal and to said second terminal.

10. A regulated potential supply as set forth in claim 4 wherein said means for supplying an error signal comprises a current mirror amplifier having input and output connections to which the collector electrodes of said second and said first transistors are respectively connected; and wherein said means responsive to said error signal comprises a fifth transistor of said first conductivity type having a base electrode to which the output connection of said current mirror amplifier is connected, and having emitter and collector electrodes connected responsive to said first terminal and to said second terminal.

11. A regulated potential supply as set forth in claim 4 wherein said means for supplying an error signal includes a differential input amplifier having inverting and non-inverting connections and an output connection, a first resistor responsive to the collector current of said second transistor for applying a potential to the inverting connection of said differential-input amplifier, and a second resistor responsive to the collector current of said first transistor for applying a potential to the non-inverting connection of said differential input amplifier; and wherein said means responsive to said error signal comprises a direct current conductive connection of the output connection of said differential-input amplifier to said second terminal.

12. A regulated potential supply as set forth in claim 1 having first and second transistors of a first conductivity type and third and fourth transistors of a second conductivity type complementary to the first conductivity type, each of said transistors having base and emitter electrodes with a base-emitter junction therebetween and having a collector electrode; means supplying a current to an interconnection between the base electrodes of said first and said second transistors of a poling for forward-biasing their respective base-emitter junctions; first direct current conductive means connecting the emitter electrodes of said first and said third transistors for providing said first transistor means, the base electrode of said third transistor having the control terminal of said first transistor means direct coupled thereto, the collector electrode of said third transistor being biased to condition it for common-collector amplifier operation, and the collector electrode of said first transistor supplying the output current of said first transistor means; and second direct current conductive means connecting the emitter electrodes of said second and said fourth transistors for providing said second transistor means, the base electrode of said fourth transistor having the control terminal of said second transistor means direct coupled thereto, the collector electrode of said fourth transistor being biased to condition it for common-collector amplifier operation, and the collector electrode of said second transistor supplying the output current of said second transistor means.

13. A regulated potential supply as set forth in claim 12 wherein said means for supplying an error signal comprises a current mirror amplifier having input and output connections to which the collector electrodes of said second and said first transistors are respectively connected; and wherein said means responsive to said error signal comprises a fifth transistor of said first conductivity type having a base electrode to which the output connection of said current mirror amplifier is direct coupled, having a collector electrode biased to condition said fifth transistor for common-collector amplifier operation, and having an emitter electrode connected to said second terminal.

14. A regulated potential supply as set forth in claim 12 wherein said means for supplying an error signal comprises a current mirror amplifier having input and output connections to which the collector electrodes of said first and said second transistors are respectively connected; and wherein said means responsive to said error signal comprises a fifth transistor being of a second conductivity type complementary to the first conductivity type, having a base electrode to which the output connection of said current mirror amplifier is direct coupled, having an emitter electrode biased to condition said fifth transistor for common-emitter amplifier operation, and having a collector electrode connected to said second terminal.

15. A regulated potential supply as set forth in claim 12 wherein said means for supplying an error signal comprises a current mirror amplifier having input and output connections to which the collector electrodes of said second and said first transistors are respectively connected; and wherein said means for responsive to said error signal comprises a fifth transistor being of a second conductivity type complementary to said first conductivity type, having a base electrode to which the output connection of said current mirror amplifier is direct coupled, and having collector and emitter electrodes connected respectively to said first terminal and to said second terminal.

16. A regulated potential supply as set forth in claim 12 wherein said means for supplying an error signal comprises a current mirror amplifier having input and output connections to which the collector electrodes of said first and said second transistors are respectively connected; and wherein said means responsive to said error signal comprises a fifth transistor of said first conductivity type having a base electrode to which the output connection of said current mirror amplifier is connected, and having emitter and collector electrodes connected responsive to said first terminal and to said second terminal.

17. A regulated potential supply as set forth in claim 12 wherein said means for supplying an error signal includes a differential input amplifier having inverting and non-inverting connections and an output connection, a first resistor responsive to the collector current of said first transistor for applying a potential to the inverting connection of said differential-input amplifier, and a second resistor responsive to the collector current of said second transistor for applying a potential to the non-inverting connection of said differential input amplifier; and wherein said means responsive to said error signal comprises a direct current conductive connection of the output connection of said differential-input amplifier to said second terminal.

18. Differential-input amplifier comprising:

first and second input terminals;

an output terminal;

first and second transistors of a first conductivity type and third and fourth transistors of a second conductivity type complementary to said first conductivity type, each of said transistors having base and emitter electrodes with a base-emitter junction therebetween and having a collector electrode;

means direct coupling said first input terminal to the base electrode of said first transistor;

means direct coupling said second input terminal to the base electrode of said second transistor;

means biasing the collector electrodes of said first transistor and of said second transistor for conditioning them to operate as common-collector amplifiers;

first direct current conductive means between a first point of interconnection, at the base electrode of said third transistor, and the emitter electrode of said first transistor;

second direct current conductive means between a second point of interconnection, at the base electrode of said fourth transistor, and the emitter electrode of said second transistor;

means for supplying first and second currents in fixed proportion to each other;

means for applying said first and said second currents respectively to said first point of interconnection and to said second point of interconnection for causing emitter current flows in said first transistor and in said second transistor, respectively;

third and fourth direct current conductive means between a third point of interconnection and, respectively, the emitter electrode of said third transistor and the emitter electrode of said fourth transistor;

means for applying a third current to said third point of interconnection of a polarity for causing emitter current flows in said third and said fourth transistors; and means for differentially combining the resultant collector currents of said third and fourth transistors in prescribed proportions to obtain an error signal applied to said output terminal, said prescribed proportions being chosen so that said error signal is zero-valued when the potential between said first and said second input terminals has a value other than zero.

19. A differential-input amplifier as set forth in claim 18 wherein the base-emitter junctions of said first and said second transistors have like junction profiles and the effective area of the base-emitter junction of the second transistor is larger than the effective area of the base-emitter junction of the first transistor.

20. A differential-input amplifier as set forth in claim 18 wherein the base-emitter junctions of said third and said fourth transistors have like junction profiles and the effective area of the base-emitter junction of the third transistor is larger than the effective area of the base-emitter junction of the fourth transistor.

21. A differential-input amplifier as set forth in claim 18 wherein said first and said second direct current conductive means each consist of direct connections without substantial impedance.

22. A differential-input amplifier as set forth in claim 18 wherein said first and second direct current conductive means comprise respectively a first semiconductor diode means and a second semiconductor diode means, each poled for forward conduction.

23. A differential-input amplifier as set forth in claim 22 wherein said second diode means is of a type exhibiting smaller offset potential thereacross for given current level than said first diode means.

24. A differential-input amplifier as set forth in claim 18 wherein said first and said second direct current conductive means respectively comprise first and second serial connections of like numbers of semiconductor diode means poled for forward conduction.

25. A differential-input amplifier as set forth in claim 24 wherein the semiconductor diode means in said second serial connection have smaller offset potential thereacross for given current level than the semiconductor diode means in said first serial connection.

26. A differential-input amplifier as set forth in claim 18 wherein said fourth and said third direct current conductive means respectively comprise a first semiconductor diode means and a second semiconductor diode means, each poled for forward conduction.

27. A differential-input amplifier as set forth in claim 26 wherein said second diode means is of a type exhibiting smaller offset potential thereacross for given current level than said first diode means.

28. A differential-input amplifier as set forth in claim 18 wherein said fourth and said third direct current conductive means respectively comprise first and second serial connections of like numbers of semiconductor diode means poled for forward conduction.

29. A differential-input amplifier as set forth in claim 28 wherein the semiconductor diode means in said second serial connection have smaller offset potential thereacross for given current level than the semiconductor diode means for said first serial connection.

30. A differential-input amplifier comprising:

first and second input terminals;

an output terminal;

first and second transistors of a first conductivity type and third and fourth transistors of a second conductivity type complementary to said first conductivity type, each of said transistors having base and emitter electrodes with a base-emitter junction therebetween and having a collector electrode;

means direct coupling said first input terminal to the base electrode of said first transistor;

means direct coupling said second input terminal to the base electrode of said second transistor;

means biasing the collector electrodes of said first transistor and of said second transistor for conditioning them to operate as common-collector amplifiers;

means for applying a forward bias current to an interconnection of the base electrodes of the third and fourth transistors;

first direct current conductive means connecting the emitter electrodes of said first and said third transistors;

second direct current conductive means connecting the emitter electrodes of said second and said fourth transistors; and means for differentially combining the resultant collector currents of said third and said fourth transistors in prescribed proportions to obtain an error signal applied to said output terminal, said prescribed proportions being chosen so that said error signal is zero-valued when the potential between said first and said second input terminals has a value other than zero.

31. A differential-input amplifier as set forth in claim 30 wherein the base-emitter junctions of said first and said second transistors have like junction profiles and the effective area of the base-emitter junction of the second transistor is larger than the effective area of the base-emitter junction of the first transistor.

32. A differential-input amplifier as set forth in claim 30 wherein the base-emitter junctions of said third and said fourth transistors have like junction profiles and the effective area of the base-emitter junction of the third transistor is larger than the effective area of the base-emitter junction of the fourth transistor.

33. A differential-input amplifier as set forth in claim 30 wherein said first and said second direct current conductive means each consist of direct connections without substantial impedance.

34. A differential-input amplifier as set forth in claim 30 wherein said first and second direct current conductive means comprise respectively a first semiconductor diode means and a second semiconductor diode means, each poled for forward conduction.

35. A differential-input amplifier as set forth in claim 34 wherein said second diode means is of a type exhibiting smaller offset potential thereacross for given current level than said first diode means.

36. A differential-input amplifier as set forth in claim 30 wherein said first and said second direct current conductive means respectively comprise first and second serial connections of like numbers of semiconductor diode means poled for forward conduction.

37. A differential-input amplifier as set forth in claim 36 wherein the semiconductor diode means in said second serial connection have smaller offset potential thereacross for given current level than the semiconductor diode means in said first serial connection.

* * * * *